US007823737B2

(12) United States Patent
Noll et al.

(10) Patent No.: US 7,823,737 B2
(45) Date of Patent: Nov. 2, 2010

(54) PLASTIC CONTAINER WITH SUBSTANTIALLY FLAT PANELS

(75) Inventors: Angie Noll, York, PA (US); Scott Bysick, Lancaster, PA (US); Sheldon Yourist, York, PA (US); David B. Heisner, York, PA (US)

(73) Assignee: Graham Packaging Company, L.P., York, PA (US)

( * ) Notice: Subject to any disclaimer, the term of this patent is extended or adjusted under 35 U.S.C. 154(b) by 1395 days.

(21) Appl. No.: 11/047,591

(22) Filed: Feb. 2, 2005

(65) Prior Publication Data

US 2006/0175284 A1 Aug. 10, 2006

(51) Int. Cl.
*B65D 1/46* (2006.01)
*B65D 1/02* (2006.01)
*B29C 39/02* (2006.01)

(52) U.S. Cl. ..... 215/381; 215/382; 220/669; 220/671; 220/675; 264/523

(58) Field of Classification Search ..... 215/373, 215/381–383, 379, 384, 398; 220/669, 671, 220/675, 771; 264/523
See application file for complete search history.

(56) References Cited

U.S. PATENT DOCUMENTS 3,923,178 A * 12/1975 Welker, III ..... 215/381
5,064,081 A * 11/1991 Hayashi et al. ..... 215/373
5,158,817 A * 10/1992 Krishnakumar ..... 428/36.92
D331,017 S * 11/1992 Chan ..... D9/560
5,199,588 A * 4/1993 Hayashi ..... 215/381
5,222,615 A * 6/1993 Ota et al. ..... 215/375
5,279,433 A 1/1994 Krishnakumar et al.
5,341,946 A 8/1994 Vailliencourt et al.
D353,335 S * 12/1994 Cox ..... D9/541
5,971,184 A * 10/1999 Krishnakumar et al. ..... 215/384
6,016,932 A 1/2000 Gaydosh et al.
6,464,106 B1 * 10/2002 Giblin et al. ..... 222/109
6,588,612 B1 * 7/2003 Dorn et al. ..... 215/10
D480,313 S * 10/2003 Johnson et al. ..... D9/538
6,779,673 B2 * 8/2004 Melrose et al. ..... 215/381
7,059,486 B2 * 6/2006 Van Der Heijden et al. . 215/379
7,178,684 B1 * 2/2007 Budden et al. ..... 215/381
2004/0104195 A1 * 6/2004 Yourist et al. ..... 215/379
2004/0129598 A1 7/2004 Zhang et al.
2004/0140284 A1 * 7/2004 Taylor et al. ..... 215/42
2004/0144747 A1 * 7/2004 Saito et al. ..... 215/379
2004/0159626 A1 * 8/2004 Trude ..... 215/373
2005/0045645 A1 * 3/2005 Tsutsui et al. ..... 220/669

FOREIGN PATENT DOCUMENTS

WO WO 97/34808 9/1997
WO WO 00/50309 8/2000

* cited by examiner

*Primary Examiner*—Sue A Weaver
(74) *Attorney, Agent, or Firm*—Knoble Yoshida & Dunleavy, LLC

(57) ABSTRACT

The plastic container has a heel portion having an enclosed base; a body portion transitioning into the heel portion; a bell portion transitioning into the body portion; and a finish attached to the bell portion and defining an opening. The body portion is formed into a generally tubular structure by a plurality generally flat panels. Each of the panels is connected to an adjacent panel with a chamfered post, and the body portion includes at least one vertically oriented rib at each of the chamfered posts.

27 Claims, 10 Drawing Sheets

PLASTIC CONTAINER WITH SUBSTANTIALLY FLAT PANELS

BACKGROUND OF THE INVENTION

1. Field of the Invention

The present invention relates generally to plastic containers, and more particularly to hot-fillable containers.

2. Related Art

The use of blow molded plastic containers for packaging liquid product in "hot fill" applications is known. The term "hot fill" can be considered any temperature higher than room temperature. However, when referring to "hot fill" applications, conventional temperatures used in such applications are at least 180° F.

In the process of filling a plastic container with hot fill product, pressure or vacuum imposed on the container can result in permanent deformation of the container. The sidewalls of the container can deform as the container is being filled with hot fluids. In addition, the rigidity of the container decreases after the hot fill liquid is introduced into the container. The temperatures employed in these operations may be above the transition temperature (Tg) of the plastic used (for example PET), which can result in the deformation becoming permanent. In addition, as the liquid cools in a sealed container, gas that is also in the container shrinks in volume, producing a pressure less than atmospheric (or a "vacuum") in the container.

Hot fill containers often have substantially rectangular vacuum panels that are designed to collapse inwardly as the contents of the container cool after the hot-fill process. These vacuum panels help reduce unwanted deformation of the container by flexing inward under the pressure of the vacuum. By flexing inward, the vacuum panels relieve the pressure created by the vacuum and prevent or reduce the deformation of other parts of the container.

U.S. Pat. No. 5,341,946 discloses vacuum panels having multiple outwardly projecting portions which are separated by a portion of the vacuum panel. U.S. Pat. Nos. 5,279,433 and 6,016,932 disclose other configurations of vacuum panels having projecting center portions. Yet another configuration of vacuum panels having projecting center portions is disclosed in WO 97/34808.

A particularly persistent problem in the manufacture of plastic containers is known in the industry as "lightweighting." Typically, lightweighting involves redesigning a package to use less plastic material, which also tends to make the container weigh less. Manufacturers continue to develop new technologies that enable them to reduce the amount of PET resin needed to make a bottle without compromising performance. These efforts are extremely important to reduce manufacturing costs because PET resin accounts for a significant portion of the cost of the finished container. However, lightweighting of a container can result in thinner container walls. As a result, such lightweighted containers are more subject to deformation. Thus, there is a continuing need for containers that are lightweighted but still resist deformation.

BRIEF SUMMARY OF THE INVENTION

The present invention provides an improved blow molded plastic container. More particularly, the present invention provides an improved blow molded PET container suitable for accommodating a hot-fill product.

The plastic container in accordance with one embodiment of the present invention includes a heel portion having an enclosed base; a body portion transitioning into the heel portion, the body portion being defined at least in part by a plurality of generally flat panels forming a generally tubular structure, with each of the panels being connected to an adjacent panel with a chamfered post and with the body portion including at least one vertically oriented rib at each of the chamfered posts; a bell portion transitioning into the body portion; and a finish attached to the bell portion and defining an opening.

In another embodiment of the invention, the bell portion may be circular in cross-section and the body portion is one of triangular or rectangular in cross-section, The transition between the bell portion and the body portion would accommodate the circular cross-section of the bell portion to the approximately triangular or rectangular or square cross-section of the body portion.

The transition between the bell portion and the body portion generally includes an upper bumper, and the transition between the body portion and the heel portion generally includes a lower bumper.

The body portion generally includes a vertically oriented rib on either side of each of the chamfered posts. The vertically oriented ribs resist expansion of the outer walls of the container. The vertical ribs further provide an improved top loading capability.

Generally, the upper bumper may be defined by discontinuous, substantially horizontal ribs, and the lower bumper may be defined by discontinuous, substantially, horizontal ribs. In an exemplary embodiment, the upper bumper may be defined by four discontinuous horizontal ribs, and the lower bumper may be defined by four discontinuous horizontal ribs.

In an alternate embodiment, the upper bumper may be defined by at least one ring extending around the plastic container, and the lower bumper may be defined by at least one ring extending around the plastic container.

In a yet another exemplary embodiment, the base is a push-up base.

In a still further exemplary embodiment, at least one of the plurality of panels may be a vacuum panel.

The plastic container according to an exemplary embodiment may have a body portion with a cross-sectional diameter, which is about 86% to about 95% of the cross-sectional diameter of one of the heel and bell portions. For example, in an 8 ounce container, the cross-section of the body portion is about 86% of the cross-section of the bell portion or the heel portion. Other larger and smaller embodiments, of the same or different proportions, can also be provided.

In an exemplary embodiment, the body portion, the heel portion, and the bell portion are adapted for hot-fill applications and are blow molded PET.

The present invention also provides a method of reducing deformation in a plastic container, which includes: providing a heel portion having an enclosed base; providing a body portion transitioning into the heel portion, the body portion being defined at least in part by a plurality of generally flat panels forming a tubular structure, with each of the panels being connected to an adjacent panel with a chamfered post and with the body portion having at least one vertically oriented rib at each of the chamfered posts; providing a bell portion transitioning into the body portion; and providing a finish attached to the bell portion and defining an opening. At least one of the plurality of panels can include a vacuum panel.

The present invention further provides a method of manufacturing a blow molded PET container from a preform, which includes disposing a preform in a mold cavity having an interior surface, the cavity interior surface having a heel portion region defining an enclosed base; a body portion region transitioning into the heel portion region, the body portion region being defined at least in part by four generally flat panels and generally square shaped in cross-section, wherein each of the panels is connected to an adjacent panel with a chamfered post and wherein the body portion region includes at least one vertically oriented rib at each of the chamfered posts; a bell portion region transitioning into the body portion region; and defining an opening. The preform is then distended against said mold surface to form the container.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of preferred embodiments of the invention, as illustrated in the accompanying drawings wherein like reference numbers generally indicate identical, functionally similar, and/or structurally similar elements.

DETAILED DESCRIPTION OF THE INVENTION

Figure 1:
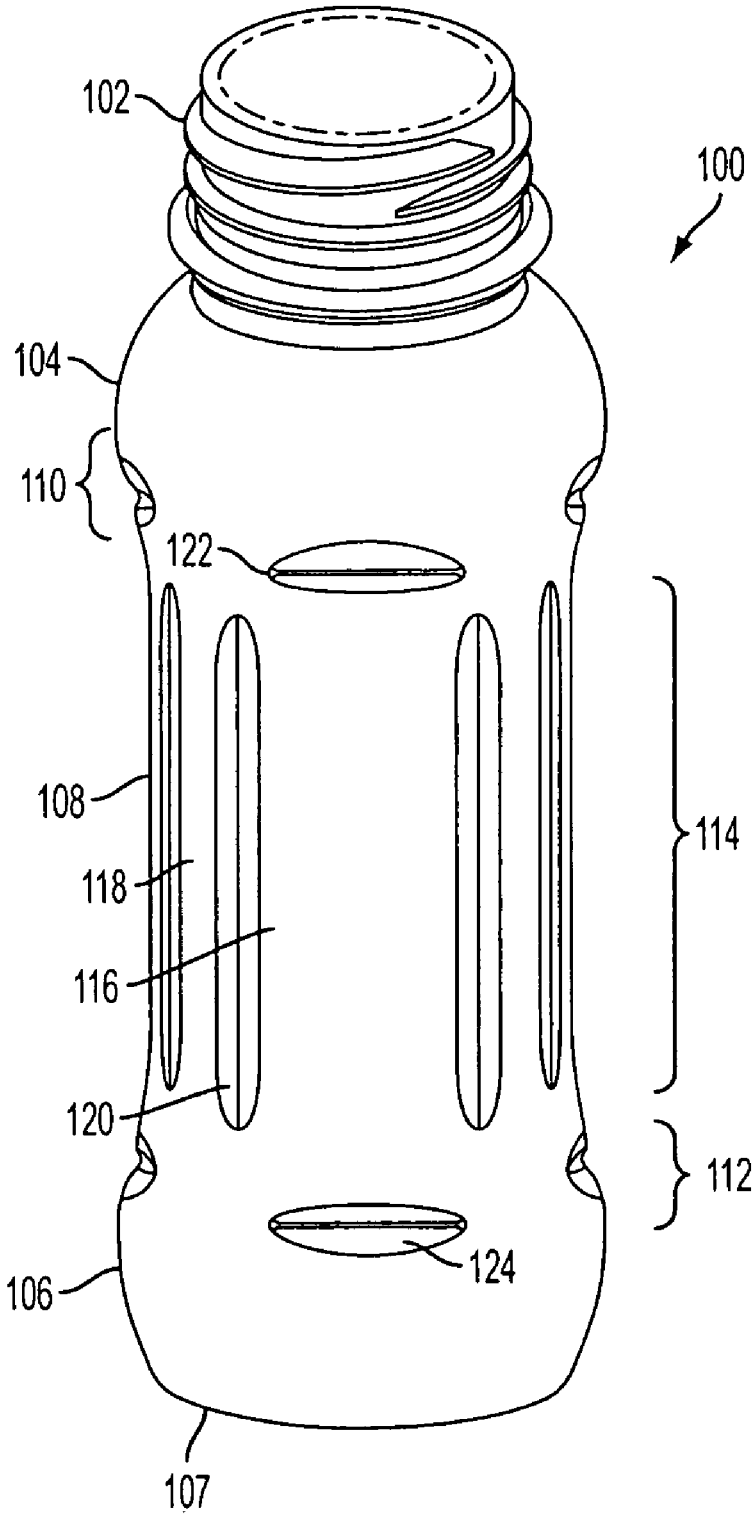
FIG. 1 is a perspective view from the top and side of the plastic container in accordance with an embodiment of the present invention.
Figure 2:
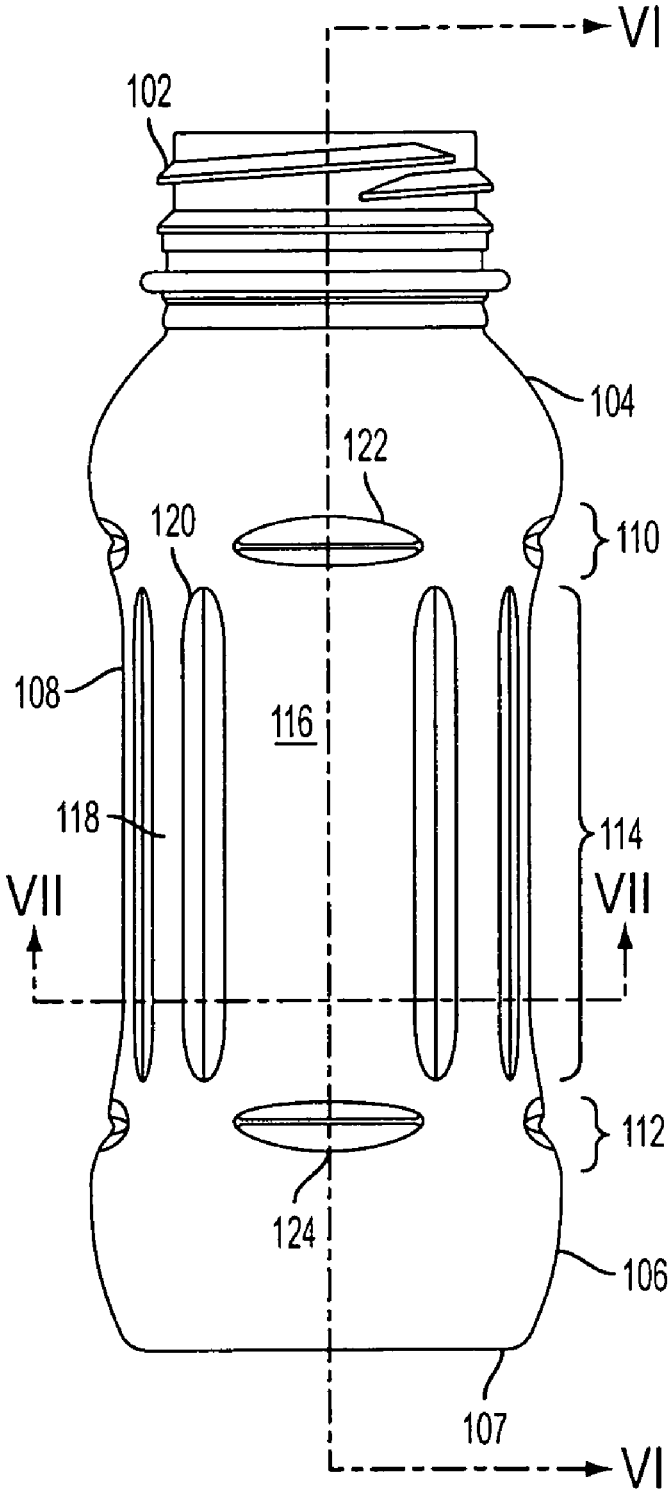
FIG. 2 is a side elevation view of the plastic container shown in FIG. 1.

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

A thin-walled container in accordance with the invention is intended to be filled with a product at a temperature above room temperature. Typically, the product is at about 180° F. According to the invention, a container may be formed from a plastic material such as, for example, polyethylene terephthlate (PET) or polyester. One method of producing such a container is blow molding. The container can be filled by automated, high speed, hot-fill equipment.

Referring now to the drawings, FIGS. 1-7 show a first embodiment of the invention. In this embodiment, a container 100 has a finish 102 for filling and dispensing fluid, a bell portion 104, a heel portion 106 and a body portion 108. The body portion 108 connects the heel portion 106 to the bell portion 104. In the illustrated embodiment, the body portion 108 transitions smoothly into the heel portion 106 and the bell portion 104. An upper label bumper 110 is provided at the transition between the body portion 108 and the bell portion 104, and a lower label bumper 112 is provided at transition between the body portion and the heel portion 106. The bottom of upper label bumper 110 and the top region of lower label bumper 112 define a label mounting area 114. A label or labels can be applied to label mounting area 114 using methods that are well known to those skilled in the art, including shrink wrap labeling and adhesive methods. The label can extend around a portion of or the entire label mounting area 114. Although the upper label bumper 110 and lower label bumper 112 are referred to as "label bumpers," it is not necessary that they define a label boundary. The bottle can also have a shrink wrap label, or other type of labeling.

Figure 3:
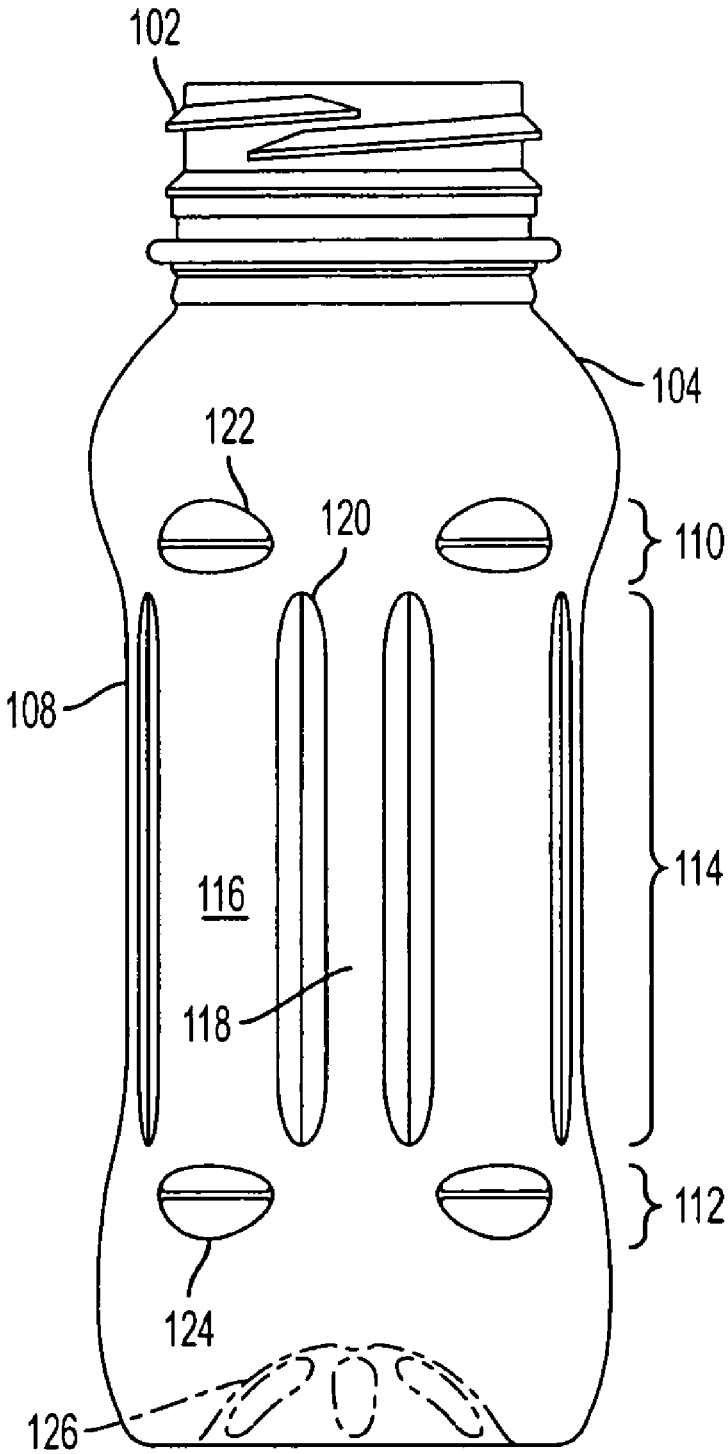
FIG. 3 is a further side elevation view of the plastic container shown in FIG. 1, rotated 45° from the view of FIG. 2.
Figure 4:
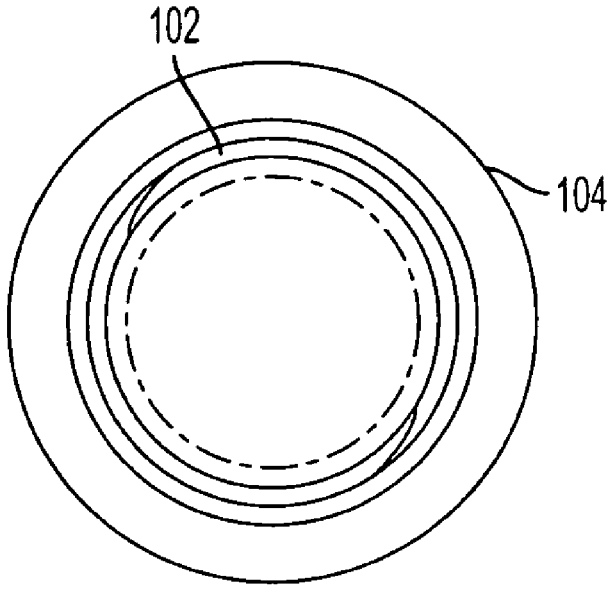
FIG. 4 is a top plan view of the plastic container shown in FIG. 1.
Figure 5:
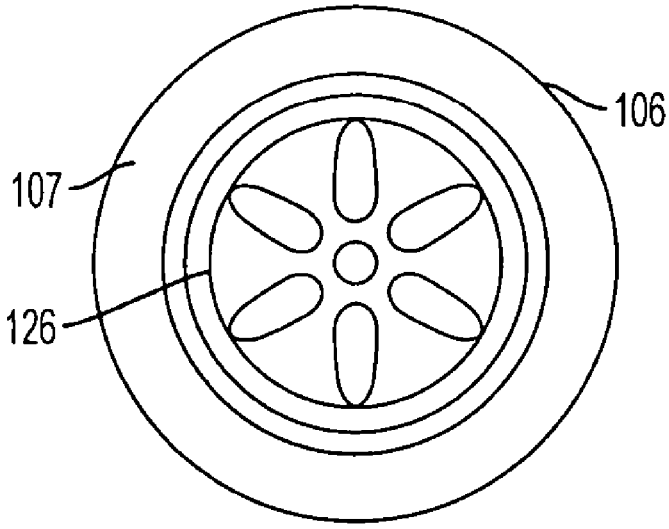
FIG. 5 is a bottom plan view of the plastic container shown in FIG. 1.
Figure 6:
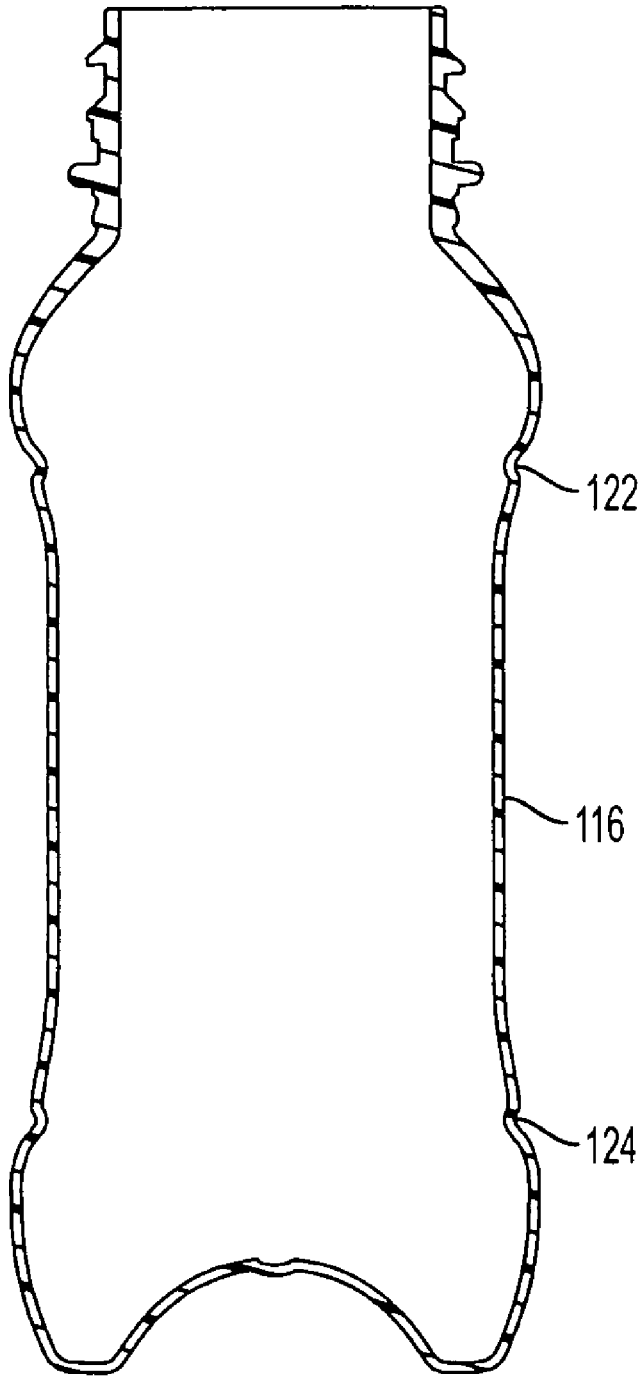
FIG. 6 is a cross-sectional view of the plastic container through line VI-VI of FIG. 2.
Figure 7:
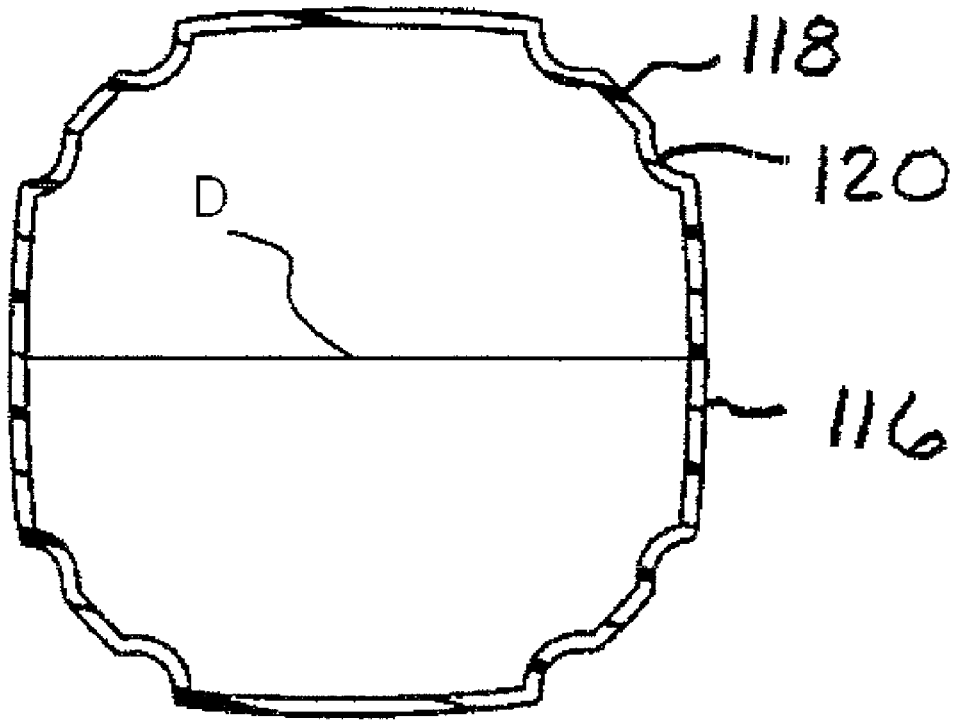
FIG. 7 is a cross-sectional view of the plastic container through line VII-VII of FIG. 2.

As shown particularly in FIGS. 3 and 5, the heel portion 106 forms an enclosed base 107 for the container 100 and can include a push-up base 126. Any acceptable push-up base shape can used.

The body portion 108 may have one or more generally flat panels 116 disposed within the label mounting area 114 to form a generally tubular structure. In the exemplary embodiment illustrated in FIGS. 1-7, the body portion 108 is comprised of four generally flat panels 116 symmetrically distributed around the body portion 108 and connected together with chamfered posts 118 that are disposed between adjacent panels. This arrangement results in the body section 108 of this embodiment having a generally square cross-section with chamfered corners, as particularly shown in FIG. 7. However, the tubular structure of the body section may be formed of three generally flat panels or as many as eight generally flat panels. Containers having body sections formed of three or four flat panels work better than a container with five to eight sides. A container with a body section having four generally flat panels is the preferred embodiment.

According to the invention, the tubular structure of body portion 108 may be formed so that adjacent panels of the body section form an approximate angle in the range of about 60° to about 90°. For example, if three generally flat panels are used the angle formed between adjacent panels would be approximately 60° and the generally tubular structure would have an approximately triangular shape. A body section 108 having four generally flat panels would have an angle of approximately 90° between adjacent panels. At least one of the generally flat panels 116 can be a vacuum panel for accommodating interior and exterior pressure changes. For example, vacuum panels flex under the pressure of hot filling and subsequent cooling to adjust for pressure changes within container. Standard vacuum panel, and/or high efficiency vacuum panel technology can be incorporated into the generally flat panels 116. In an exemplary embodiment of the present invention, at least two of the generally flat panels 116 are vacuum panels. An exemplary high efficiency vacuum panel is disclosed in International Application No. PCT/NZ00/00019, published as Publication No. WO 00/50309.

Panel designs in accordance with the invention (1) improve overall dent resistance due to reduced vacuum pressure resulting from product volume reduction, (2) provide improved label support, and (3) because of reduced vacuum pressure, allow the reduction of container weights, affording an increased number of design options for other container portions. Vacuum panels can be of any appropriate type and can have various cross-sectional shapes. For example, vacuum panels can be entirely uniform or have regions having various cross-sectional shapes including flat, concave and convex.

The body portion 108 may transition into the heel portion 106 and the bell portion 104 with an extended curved feature. Generally, the extended curved feature may be the joining of a generally circular shape to a generally square shape by a smooth outwardly curved changing radius that is tangential to each feature. While the embodiment shown in FIGS. 1-7 may have a rounded heel portion and bell portion (i.e., a cross-section of a heel portion and a cross-section of the bell portion may approximate a circular shape), the cross-section of the heel and/or bell portion may be generally square, rectangular, triangular or other polygon shaped. Both the body portion and the bell and heel portions may have rounded corners even though the above description refers to generally square, rectangular, triangular or other polygon shaped.

The ratio of the body portion 108 to the heel portion 106 and the bell portion 104 can be defined for a single serve container. Generally, conventional single serve packages have a height ratio of body portion to the bell and heel portions of about 1:1. In the exemplary embodiment, the height ratio of the body portion 108 to the bell or heel portions 104, 106 is about 2.3:1. In another exemplary embodiment, the height ratio of the body portion to the heel portion may be approximately 3.3:1; and the height ratio of the body portion to the bell portion may be about 1.6:1. Thus, depending upon the volume of the container, the height ratio of the bell or heel portion to body portion may vary from 1.6-3.3:1.

The body portion 108 further includes at least one vertically oriented rib 120. In exemplary embodiments, two vertical ribs 120 are arranged at each chamfered corner and bound the generally flat panels 116. That is, a vertical rib 120 may be disposed on either side of a post 118 thereby forming a chamfered corner. The vertical ribs 120, shown in FIGS. 1-3 and 7, are substantially the same in size. That is to say they have the same, length, width and depth. The vertical ribs may be formed by grooves or flutes. The grooves or flutes of the chamfered corner may be beveled or rounded. In the embodiment shown in FIGS. 1-7, post 118 may be disposed at an angle to each adjacent generally flat panel. Alternatively, post 118 may be a curved post between two vertical ribs 120. The illustrated vertical ribs 120 are perpendicular to a plane defining a cross-section of the base 107, but could alternatively be non-perpendicular to the plane defining a cross-section of the base 107. The vertical ribs 120 provide stability to the container 100 by, for example, improving top load capabilities.

As shown in the embodiments of FIGS. 1-7, the upper bumper 110 may be defined by a series of discontinuous, generally horizontal ribs 122. Similarly, the lower bumper 112 may be defined by a series of discontinuous, generally horizontal ribs 124. The generally horizontal ribs 122, 124 may be arced from one side to the other side, but have an indented line that generally runs in a horizontal direction. Plastic container 100 may include four horizontal ribs 122 for the upper bumper 110 and four horizontal ribs 124 for the lower bumper 112. The horizontal ribs 122, 124 are generally located between the vertical ribs 120 and above and below the generally flat panels 116. In another embodiment of the invention, the upper and lower bumpers 110, 112 may be a continuous offset ridge from the generally flat panel 116. In this embodiment, the rib 122, 124 that runs in the horizontal direction may be part of the bell portion or the heel portion, respectively. The illustrated horizontal ribs 122, 124 are parallel to base 107, but could alternatively be non-parallel to the base 107. The substantially, horizontal ribs 122, 124 provide added support to the container while being a less abrupt transition, and are thus unapparent to the consumer, improving the aesthetics of the container. The ribs 122, 124 can also be decorative as well as structural in that the shape of the ribs may be more than horizontal around the container.

The overall effect of the horizontal ribs is to resist the expansion of the outer wall of the container. Bulging or "barreling" is prevented or diminished when the container is subjected to fill pressure at high temperatures. These structural improvements to resist expansion can be used in conjunction with panel technology that allows for increased flexing of the vacuum panel sidewalls so that the pressure on the container may be more readily accommodated. Reinforcing ribs of various types and location may still be used, as described above, to compensate for any excess stress that will inevitably be present from the flexing of the container walls into the new "pressure-adjusted" condition by ambient forces.

In addition, the vertical ribs 120 are similar to the horizontal ribs 122 in that the vertical ribs 120 aid in reducing and/or preventing deformation. In particular, the vertical ribs 120 aid in reducing and/or preventing the effect that the generally flat panels 116 have on deforming the chamfered corners when under pressure.

The size of the generally flat panels 116, the horizontal ribs 122, 124, and the vertical ribs 120 may vary depending on container size, plastic composition, bottle filling conditions and expected contents.

Figure 9:
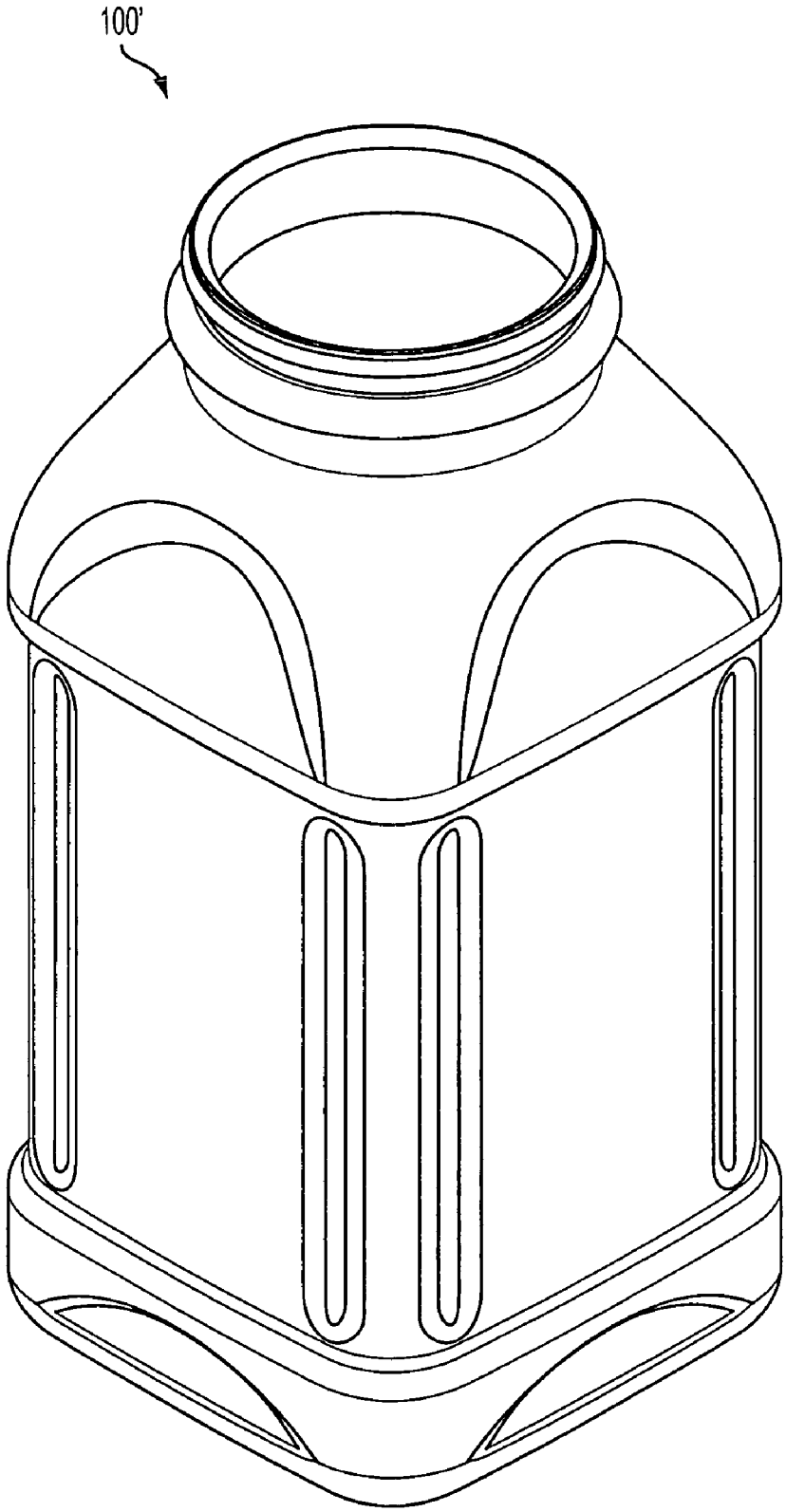
FIG. 9 is a perspective view of another alternate embodiment of the plastic container of the present invention.
Figure 10:
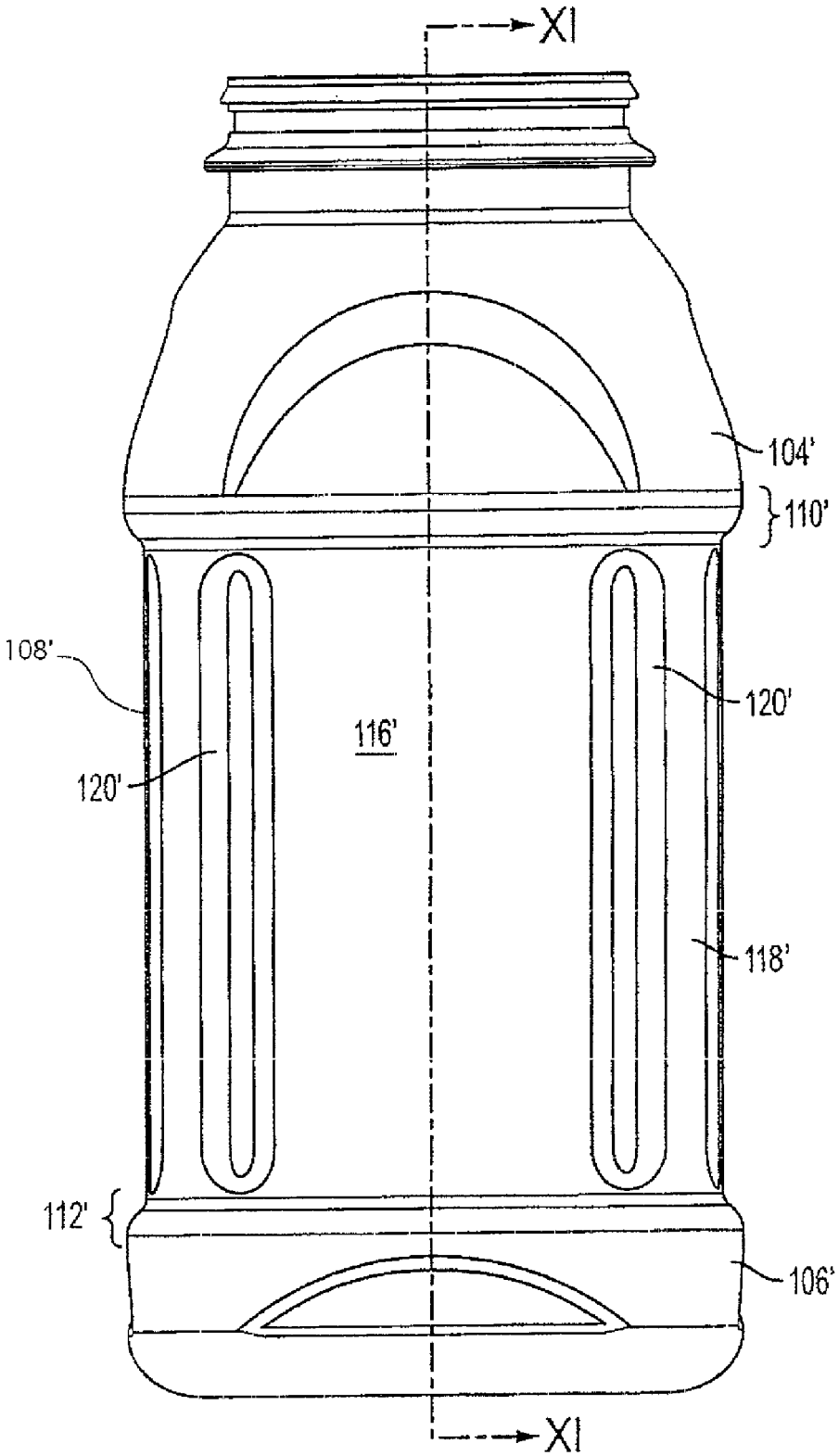
FIG. 10 is a side elevational view of the plastic container shown in FIG. 9 of the present invention.
Figure 11:
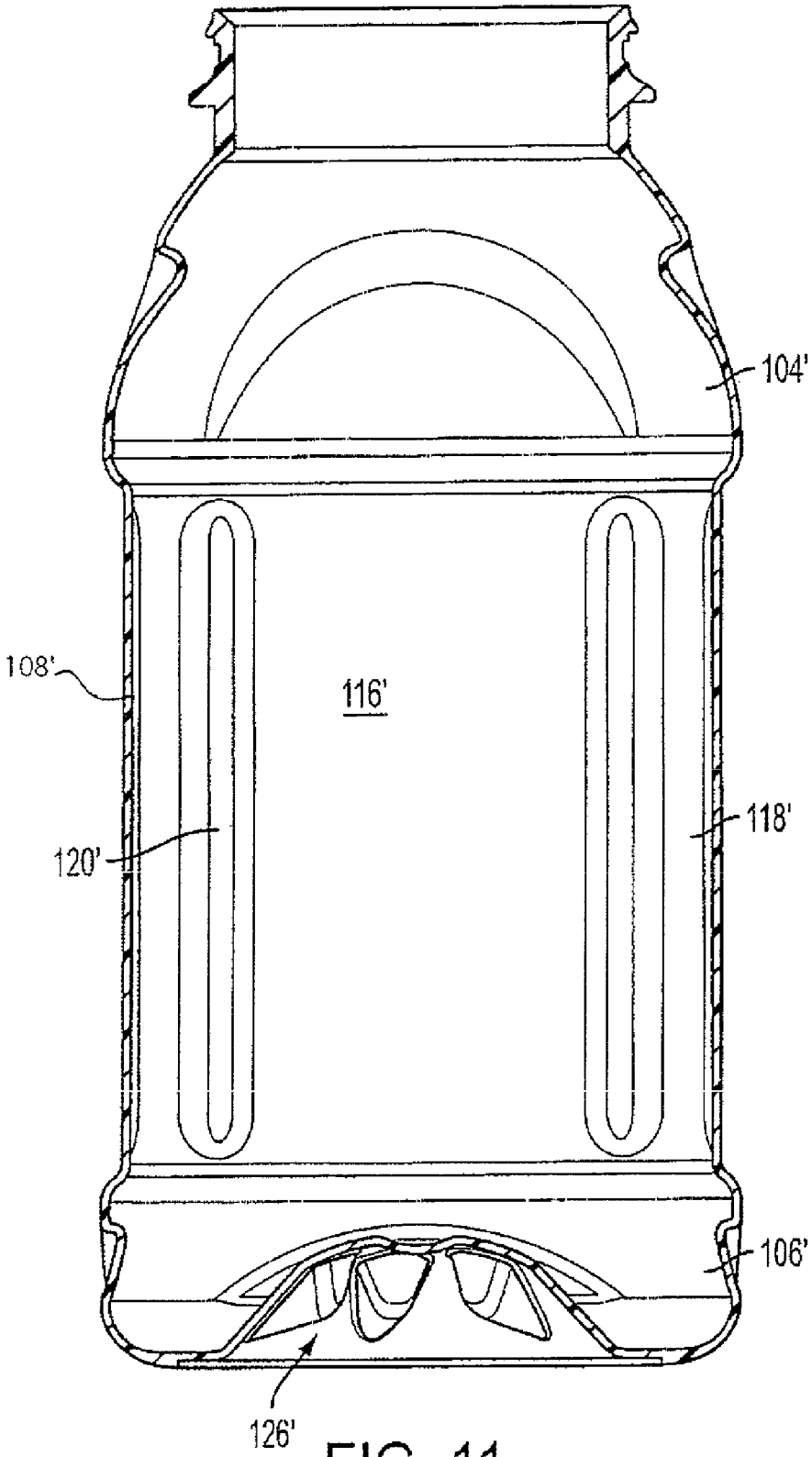
FIG. 11 is a cross-sectional view of the plastic container through line XI-XI of FIG. 10.

In the exemplary embodiment shown in FIGS. 1-7, the body portion 108, the heel portion 106, and the bell portion 104 defining the container 100 may have an interior space suitable for containing eight ounces of liquid product. In another embodiment (FIGS. 9-11), the cross-sections of a container 100' may have an approximately square bell portion 104', body portion 108' and heel portion 106' where the interior space is suitable to containing 10 ounces of liquid product. This embodiment may be shorten in height compared to an eight ounce container, if the diameters of the cross-section (s) is larger than that of the cross-section(s) of the eight ounce container. Elements of FIGS. 9-11 that are similar to those in FIGS. 1-7 are primed and the description of the primed element is similar to that of the unprimed element.

An example of particularly useful dimensions for the container of the present invention follows: the body portion 108 has a cross-sectional diameter of about 1.890 inches and the heel portion 106 and bell portion 104 each have a cross-sectional diameter of about 2.205 inches. The cross-sectional diameter of the body portion, shown in FIG. 7 as "D", may be about 84-95% of the cross-sectional diameter of the bell or heel portion. The finish 102 may have a diameter of about 1.390 inches. The container 100 may have a height of in the range of 5.0-5.8 inches. Smaller heights are possible if the cross-sectional diameters of the container increase. Likewise, smaller or larger heights are possible depending upon the amount of volume in a container and the diameter of the container.

The above dimensions are offered by way of example only. The dimensions are a function of the size of the container and may be increased or decreased depending on the size and performance requirements of the container. The increased or decreased dimensions can be proportionate to the exemplary dimensions or disproportionate to the exemplary dimensions.

Figure 8:
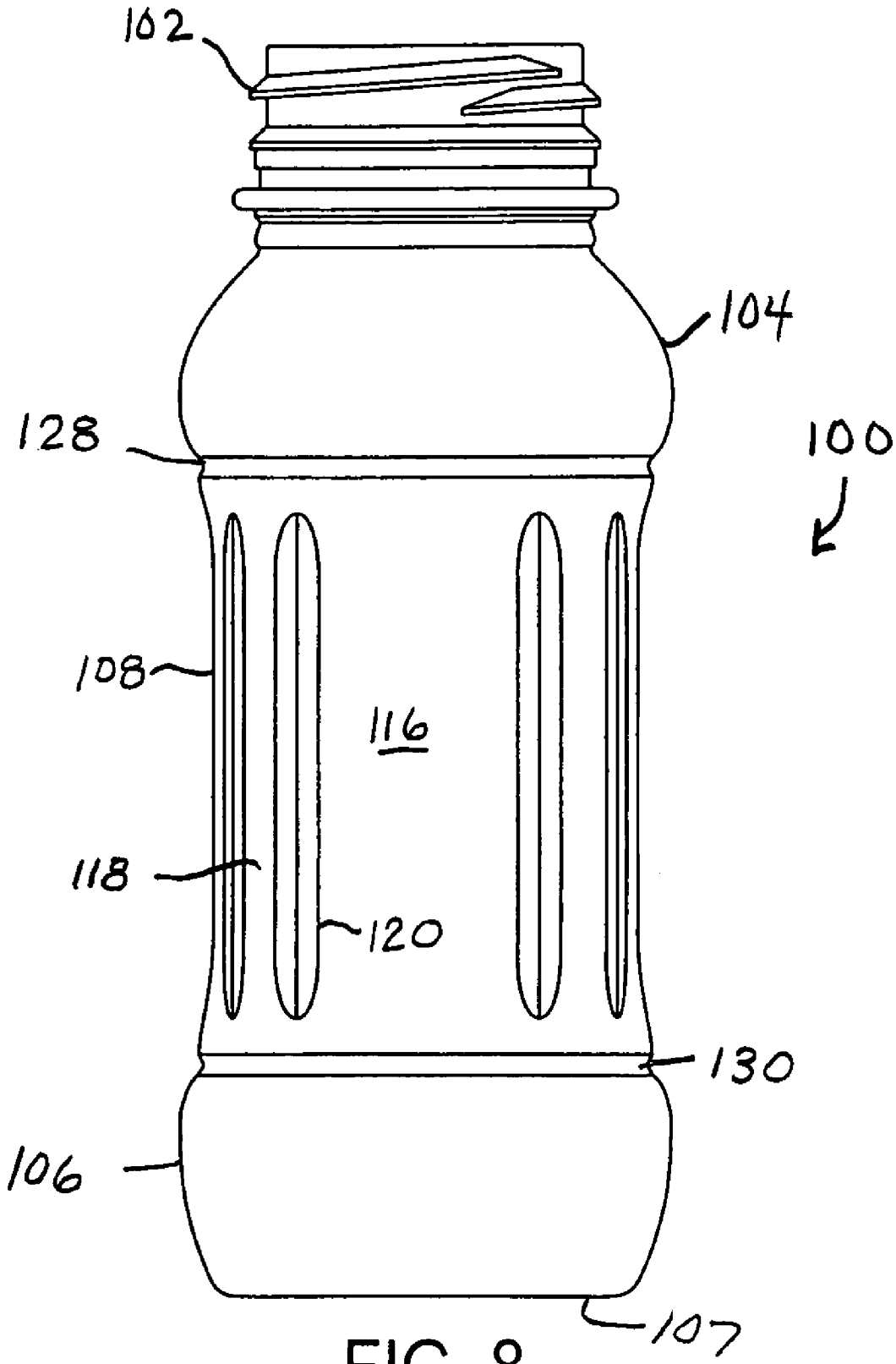
FIG. 8 is an alternate embodiment of the plastic container of the present invention.

In an alternative embodiment, as shown in FIG. 8, the upper bumper is defined by a continuous ring 128, and the lower bumper is defined by a continuous ring 130.

Furthermore, combinations of horizontal ribs and continuous rings can be utilized to achieve the desired characteristics. The rings 128, 130 provide additional stability as compared to the horizontal ribs 122, 124 shown in the embodiment of FIGS. 1-7. For example, the rings 128, 130 can prevent or minimize deformation in the heel or bell portion due to internal and external forces.

The container can be made of plastics such as polyesters, for example polyethylene terephthalate (PET); polyolefins, for example polyethylene and polypropylene; and polyamides, such as nylons. The structures can by formed of a single layer or multiple layers of like or different materials. The side walls can include additives, for example materials to improve barrier properties, or to bind various layers.

All references cited in this specification are hereby incorporated by reference. The discussion of the references herein is intended merely to summarize the assertions made by their authors and no admission is made that any reference constitutes prior art relevant to patentability. Applicants reserve the right to challenge the accuracy and pertinence of the cited references.

The embodiments illustrated and discussed in this specification are intended only to teach those skilled in the art the best way known to the inventors to make and use the invention. Nothing in this specification should be considered as limiting the scope of the invention. All examples presented are representative and non-limiting. The above-described embodiments of the invention may be modified or varied, without departing from the invention, as appreciated by those skilled in the art in light of the above teachings. It is therefore to be understood that the invention may be practiced otherwise than as specifically described.

The invention claimed is:

1. A plastic container comprising:

a heel portion having an enclosed base;

a body portion transitioning into the heel portion, the body portion having a plurality of generally flat panels forming a generally tubular structure in cross-section, wherein each of the panels is connected to an adjacent panel with a chamfered post and wherein the body portion includes at least one vertically oriented rib located adjacent to each of the chamfered posts, wherein each of the vertically oriented ribs are substantially equal in size;

a bell portion transitioning into the body portion; and a finish attached to the bell portion and defining an opening.

2. The plastic container of claim 1, wherein adjacent panels of the body portion form an angle in the range of about 60° to about 90°.

3. The plastic container of claim 1, wherein the plurality of generally flat panels includes four generally flat panels and the generally tubular cross-section is approximately square shaped.

4. The plastic container of claim 1, wherein the transition between the bell portion and the body portion includes at least one upper bumper and the transition between the body portion and the heel portion includes a lower bumper.

5. The plastic container of claim 1, wherein the body portion includes two vertically oriented ribs at each of the chamfered posts, one vertically oriented rib on either side of each of the chamfered posts.

6. The plastic container of claim 4, wherein the upper bumper includes a plurality of discontinuous, substantially horizontal ribs.

7. The plastic container of claim 4, wherein the lower bumper includes a plurality of discontinuous, substantially horizontal ribs.

8. The plastic container of claim 6, wherein the upper bumper includes four discontinuous, substantially horizontal ribs.

9. The plastic container of claim 7, wherein the lower bumper includes four discontinuous, substantially horizontal ribs.

10. The plastic container of claim 4, wherein the upper bumper includes at least one ring extending around the plastic container.

11. The plastic container of claim 4, wherein the lower bumper includes at least one ring extending around the plastic container.

12. The plastic container of claim 1, wherein the base is a push-up base.

13. The plastic container of claim 1, wherein at least one of the plurality of panels is a vacuum panel.

14. The plastic container of claim 1, wherein the body portion has a cross-sectional diameter, which is about 86% to about 94% of the cross-sectional diameter of one of the heel and bell portions.

15. The plastic container of claim 1, wherein the heel portion and the bell portion are generally circular in cross-section.

16. The plastic container of claim 1, wherein the body portion, the heel portion, and the bell portion are adapted for hot-fill applications.

17. The plastic container of claim 1, wherein the body portion, the heel portion, and the bell portion are blow molded PET.

18. A method for preventing deformation of a plastic container comprising:

providing a heel portion having an enclosed base;

providing a body portion transitioning into the heel portion, the body portion having a plurality of generally flat panels forming a generally tubular structure, wherein each of the panels is connected to an adjacent panel with a chamfered post and wherein the body portion includes at least one vertically oriented rib located adjacent to each of the chamfered posts; wherein each of the vertically oriented ribs are substantially equal in size;

providing a bell portion transitioning into the body portion; and providing a finish attached to the bell portion and defining an opening.

19. The method of claim 18, wherein the providing the body portion step includes providing four generally flat panels as the plurality of generally flat panels and the generally tubular structure is substantially square shaped.

20. The method of claim 18, wherein the providing the body portion step includes providing a vacuum panel as at least one of the plurality of panels.

21. The method of claim 18, wherein the step of providing the heel portion provides a heel portion that is generally circular in cross-section.

22. The method of claim 18, wherein the step of providing the bell portion provides a bell portion that is generally circular in cross-section.

23. A method of manufacturing a blow molded PET container, comprising:

forming a container having a heel portion region defining an enclosed base;

a body portion region transitioning into the heel portion region, the body portion region having a plurality of generally flat panels forming a generally tubular structure, wherein each of the panels is connected to an adjacent panel with a chamfered post and wherein the body portion region includes at least one vertically oriented rib located adjacent to each of the chamfered posts; wherein each of the vertically oriented ribs are substantially equal in size;

a bell portion region transitioning into the body portion region; and a finish region attached to the bell portion region and defining an opening.

24. The method of claim 23, wherein the plurality of generally flat panels is four generally flat panels and the generally tubular structure is substantially square shaped.

25. The method of claim 23, wherein at least one of the flat panels is a vacuum panel.

26. The method of claim 23, wherein the heel portion is generally circular in cross-section.

27. The method of claim 23, wherein the bell portion is generally circular in cross-section.

* * * * *